US011223169B2

(12) United States Patent
Zheng et al.

(10) Patent No.: US 11,223,169 B2
(45) Date of Patent: Jan. 11, 2022

(54) COAXIAL CONNECTOR AND METHOD FOR PRODUCING THE OUTER CONTACT OF THE SAME

(71) Applicant: CommScope Technologies LLC, Hickory, NC (US)

(72) Inventors: Jien Zheng, Jiangsu (CN); JianPing Wu, Jiangsu (CN); Yujun Zhang, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 16/958,127

(22) PCT Filed: Jan. 3, 2019

(86) PCT No.: PCT/US2019/012131
§ 371 (c)(1),
(2) Date: Jun. 25, 2020

(87) PCT Pub. No.: WO2019/136115
PCT Pub. Date: Jul. 11, 2019

(65) Prior Publication Data

US 2020/0366039 A1 Nov. 19, 2020

(30) Foreign Application Priority Data

Jan. 5, 2018 (CN) ..... 201810009189.9

(51) Int. Cl.
*H01R 24/40* (2011.01)
*B21D 19/12* (2006.01)
(Continued)

(52) U.S. Cl.
CPC ..... *H01R 24/40* (2013.01); *B21D 19/12* (2013.01); *B21D 28/28* (2013.01); *H01R 13/11* (2013.01); *H01R 43/16* (2013.01); *H01R 2103/00* (2013.01)

(58) Field of Classification Search
CPC ..... H01R 24/40; H01R 13/11; H01R 13/16; H01R 2103/00; B21D 19/12; B21D 28/28
(Continued)

(56) References Cited

U.S. PATENT DOCUMENTS 4,206,963 A * 6/1980 English ..... H01R 24/42 439/578
4,374,606 A * 2/1983 Lathrop ..... H01R 24/40 439/585
(Continued)

OTHER PUBLICATIONS

International Search Report and Written Opinion corresponding to International Application No. PCT/US2019/012131 dated Apr. 24, 2019.
(Continued)

*Primary Examiner* — Peter G Leigh
(74) *Attorney, Agent, or Firm* — Myers Bigel, P.A.

(57) ABSTRACT

The present disclosure relates to a coaxial connector and a method for producing an outer contact of the coaxial connector. The coaxial connector comprises a body, an inner contact, an outer contact, and a dielectric spacer. The body may be provided with a through hollow cavity, and the inner contact and the outer contact may be coaxially arranged in the hollow cavity of the body and may be spaced apart radially by the dielectric spacer. The outer contact may be in a shape of thin-wall cylinder and may comprise a plurality of spring fingers. The plurality of spring fingers may be spaced apart circumferentially by a plurality of slots. An end of each spring finger may be provided with a flange, and each flange may extend outwardly in a radial direction and
(Continued)

comprises an arc portion and a flat portion. The outer contact with such a structure may provide a good interconnection quality when mating with a corresponding mating connector. The outer contact of the coaxial connector may be formed by stamping a tube, which, compared with prior art method, significantly increases the processing efficiency and reduces material and personnel costs.

11 Claims, 2 Drawing Sheets

(51) Int. Cl.

| | |
|---|---|
| ***B21D 28/28*** | (2006.01) |
| ***H01R 13/11*** | (2006.01) |
| ***H01R 43/16*** | (2006.01) |
| *H01R 103/00* | (2006.01) |

(58) Field of Classification Search
USPC ..... 439/578
See application file for complete search history.

(56) References Cited

U.S. PATENT DOCUMENTS

| | | | | |
|---|---|---|---|---|
| 5,055,068 | A | 10/1991 | Machura et al. | |
| 6,024,609 | A | 2/2000 | Kooiman et al. | |
| 6,036,540 | A * | 3/2000 | Beloritsky | H01R 24/542 439/582 |
| 6,361,348 | B1 * | 3/2002 | Hall | H01R 13/6277 439/352 |
| 6,450,829 | B1 * | 9/2002 | Weisz-Margulescu | H01R 13/424 439/263 |
| 6,607,398 | B2 * | 8/2003 | Henningsen | H01R 24/566 439/578 |
| 6,695,636 | B2 * | 2/2004 | Hall | H01R 13/6277 439/352 |
| 6,827,608 | B2 * | 12/2004 | Hall | H01R 13/6315 439/578 |
| 7,309,255 | B2 | 12/2007 | Rodrigues | |
| 8,388,377 | B2 | 3/2013 | Zraik | |
| 8,597,050 | B2 * | 12/2013 | Flaherty | H01R 31/06 439/578 |
| 9,425,548 | B2 * | 8/2016 | Van Swearingen | H01R 24/44 |
| 9,525,220 | B1 * | 12/2016 | Burris | H01R 24/40 |
| 2013/0065433 | A1 | 3/2013 | Burris | |
| 2014/0322968 | A1 * | 10/2014 | Burris | H01R 9/05 439/578 |
| 2016/0322751 | A1 * | 11/2016 | Van Swearingen | H01R 13/642 |
| 2016/0365651 | A1 * | 12/2016 | Vaccaro | H01R 4/028 |

OTHER PUBLICATIONS

International Preliminary Report on Patentability corresponding to International Application No. PCT/US2019/012131 dated Jul. 16, 2020.

"Office Action corresponding to Chinese Application No. 201810009189.9 dated Jul. 5, 2021".

"Extended European Search Report corresponding to European Application No. 19735722.1 dated Aug. 26, 2021".

* cited by examiner

COAXIAL CONNECTOR AND METHOD FOR PRODUCING THE OUTER CONTACT OF THE SAME

RELATED APPLICATIONS

The present application is a 35 U.S.C. § 371 national phase application of and claims priority to PCT Application PCT/US2019/012131 filed Jan. 3, 2019, which claims priority from and the benefit of Chinese Patent Application No. 2018100091899, filed Jan. 5, 2018, the disclosure of each of which is hereby incorporated herein in its by reference entirety.

TECHNICAL FIELD

The present disclosure generally relates to the field of radio frequency communication systems. More specifically, the present disclosure relates to a coaxial connector used in radio frequency communication systems and the method for producing the outer contact of the same.

BACKGROUND

Coaxial connectors are generally used in radio frequency communication systems that require high accuracy and reliability. The coaxial connectors may be applied to ends of coaxial cables or interfaces of some mobile devices.

A coaxial connector can be categorized into male connector and female connector according to the pattern of the interfaces thereof. The interfaces of the male connector and the female connector mate with each other, so as to provide an electrical connection therebetween. The exterior of one of the male connector and the female connector is generally provided with a coupling nut, so that when the coupling nut is screwed onto the other of the male connector and the female connector, the coupling nut firmly couples the male connector and the female connector, thereby forming a reliable electro-mechanical connection between the male connector and the female connector.

A typical male connector usually comprises: an inner contact (which is generally a pin or a post) commonly used for connection with the inner conductor of the cable; an outer contact commonly used for connection with the outer conductor of the cable, the interior of the outer contact has a hollow cavity extending along the axial direction thereof, such that the outer contact circumferentially surrounds the inner contact and is spaced apart from the inner contact; and a dielectric spacer, which is arranged between the inner contact and the outer contact.

A typical female connector has a structure that is similar to the male connector; however, the inner contact of the female connector is a sleeve (i.e. having a hollow-cavity extending along the axial direction thereof), which mates with the inner contact (pin or post) of the male connector.

When the male connector mates with the female connector, the inner contact (pin or post) of the male connector is elastically inserted into the inner contact (sleeve) of the female connector, and the outer contact of the male connector is outside the outer contact of the female connector and is elastically abutted by the outer contact of the female connector in the radial direction.

For a coaxial connector used in radio frequency communication systems, Passive Intermodulation (PIM) is an important interconnection quality property. PIM is a form of electrical interference/signal transmission degradation that may occur when interconnections are not so symmetrical and/or when electro-mechanical interconnections shift or degrade over time. Interconnections may shift due to mechanical stress, vibration, thermal cycling, and/or material degradation. PIM generated by a single low quality interconnection may degrade the electrical performance of the entire radio frequency communication system. Thus, it is generally desired to reduce the PIM via connector design.

In recent years, in order to facilitate connection of the male connector with the female connector and to reduce the PIM, the outer contact of the female connector is often configured with a certain elasticity and employing a slotted structure. Specifically, a plurality of slots are provided on the outer contact of the female connector. The plurality of slots extend in the axial direction and are spaced apart in the circumferential direction. The slotted structure not only facilitates the elastic deformation of the outer contact of the female connector, so that the connection of the male connector with the female connector becomes easier.

However, when the female connector with such a slotted structure mates with the male connector, since the slotted structure facilitates elastic deformation of the outer contact of the female connector, on occasion mating problems occur. For example, it is well known that there are various kinds of coaxial connectors of different specifications in the prior art, such as 4.3/10 and 4.1/9.5 connectors, that have similar sizes. Therefore, during the installation, the operator will have difficulty identifying the coaxial connectors of different specifications, and thus will be apt to insert the male connector of one specification (e.g., a 4.1/9.5 connector) into the female connector of another specification (e.g., 4.3/10 connector) in error.

When the female connector with a slotted structure mistakenly mates with the male connector of a smaller specification in some cases (for example, the female 4.3/10 connector mistakenly mates with the male 4.1/9.5 connector), it will be possible for the outer contact of the male connector to be mistakenly inserted into the outer contact of the female connector, which can deflect, hurt or otherwise damage the outer contact of the female connector.

Thus, in order to avoid the abovementioned disadvantages and to improve the interconnection quality of the connectors, it is necessary to further improve the outer contact of the female connector.

In addition, traditionally, it is often to produce the outer contact of a female connector by machining a bar stock. Such a method has many defects. For example, since the outer contact of the female connector is of a thin-wall cylindrical structure, machining a bar stock will produce a great amount of waste, which enormously increases the material cost; in addition, machining a bar stock takes a long time and is of a high machining cost.

There are also other methods to produce the outer contact of a female connector in the prior art. For example, a coaxial connector is produced by stamping a sheet and then rolling the sheet into a cylinder. However, such a coaxial connector produced by stamping and rolling the sheet has a splice seam, which is of poor strength and rigidity and may split open, and thus will affect the interconnection quality of the connector. Therefore, it is also necessary to improve the method for producing the outer contact of a female connector.

SUMMARY

One object of the present disclosure is to provide a coaxial connector which overcomes at least one of disadvantages of the prior art. Another object of the present disclosure is to provide an improved method for producing an outer contact of a coaxial connector.

According to one aspect of the present disclosure, a coaxial connector is provided. The coaxial connector comprises a body, an inner contact, an outer contact, and a dielectric spacer. The body may be provided with a through hollow cavity, and the inner contact and the outer contact may be coaxially arranged in the hollow cavity of the body and may be spaced apart radially by the dielectric spacer. The outer contact may be in a shape of thin-wall cylinder and may comprise a plurality of spring fingers. The plurality of spring fingers may be spaced apart circumferentially by a plurality of slots. An end of each spring finger may be provided with a flange, and the flanges may extend outwardly in a radial direction. The outer contact may be formed by stamping a tube.

In an embodiment of the present disclosure, the flange of each spring finger may comprise an arc portion and a flat portion.

In an embodiment of the present disclosure, the arc portion and the flat portion may be connected smoothly or may have a smooth transition.

In an embodiment of the present disclosure, the smooth transition may be a part of the arc portion.

In an embodiment of the present disclosure, when the coaxial connector mates with a corresponding mating connector, the flanges may form an interfacial contact with respective portions of a mating connector.

In an embodiment of the present disclosure, when the coaxial connector mates with a corresponding mating connector, elastic deformations of the spring fingers in radial direction may be equal to or less than 0.30 mm.

In an embodiment of the present disclosure, the tube may be a copper tube. Preferably, the tube may be a phosphorus copper tube.

According to one aspect of the present disclosure, a method for producing an outer contact of a coaxial connector is provided. The outer contact being in a shape of thin-wall cylinder, and the method comprises:

providing a tube, a wall thickness of the tube is substantially equal to a wall thickness of the outer contact and an outer diameter of the tube is smaller than a predetermined maximum outer diameter of the outer contact;

stamping a plurality of slots on the tube, said plurality of slots extending a specific length from a proximal end toward a distal end axially and spaced apart from each other circumferentially, thereby forming a plurality of spring fingers;

stamping and everting an end of each spring finger of said plurality of spring fingers to form a flange extending outwardly to a specific distance along a radial direction.

In an embodiment of the present disclosure, the flange of each spring finger may be formed with an arc portion and a flat portion.

In an embodiment of the present disclosure, the arc portion and the flat portion of the flange may be configure to smoothly connect with each other or have a smooth transition.

In an embodiment of the present disclosure, the smooth transition may be configured as a part of the arc portion.

In an embodiment of the present disclosure, the arc portion and the flat portion of the flange may be formed by stamping.

In an embodiment of the present disclosure, the arc portion and the flat portion of the flange may be formed by machining.

In an embodiment of the present disclosure, the flanges may be configured to form an interfacial contact with respective portions of a mating connector when the coaxial connector mates with a corresponding mating connector.

In an embodiment of the present disclosure, the spring fingers may be configured to have elastic deformations being equal to or less than 0.30 mm in the radial direction when the coaxial connector mates with a corresponding mating connector.

BRIEF DESCRIPTION OF THE DRAWINGS

By reading the following detailed description of corresponding embodiments with references to the below listed accompanying drawings, a person skilled in the art will understand the corresponding embodiments and the advantages of the other embodiments. In addition, it is unnecessary to draw the features of the accompanying drawings to be discussed below to scale. The sizes of the features and elements in the drawings may be enlarged or reduced to indicate the embodiments of the present disclosure more clearly. Wherein.

DETAILED EMBODIMENTS

The present disclosure will be described with reference to the accompanying drawings, in which some embodiments of the present disclosure are shown. However, the present disclosure may be embodied in many different forms and should not be construed as limited to the embodiments that are pictured and described herein.

Unless otherwise defined, all the technical and scientific terms used in the present disclosure have the same meanings as the meanings usually understood by a person skilled in the art. The terminology used in the present description is for the purpose of describing particular embodiments only and is not intended to be limiting of the disclosure. As used in the present disclosure, the singular forms "a", "an" and "the" are intended to include the plural forms as well, unless the context clearly indicates otherwise. It will also be understood that when an element (e.g., a device, circuit, etc.) is referred to as being "connected" or "coupled" to another element, it can be directly connected or coupled to the other element or intervening elements may be present. In contrast, when an element is referred to as being "directly connected" or "directly coupled" to another element, there are no intervening elements present.

In the present disclosure, the term of "proximal end" refers to an end where the female connector mates with the male connector. In contrast, the term of "distant end" refers to an end opposite to the proximal end.

Figure 1:
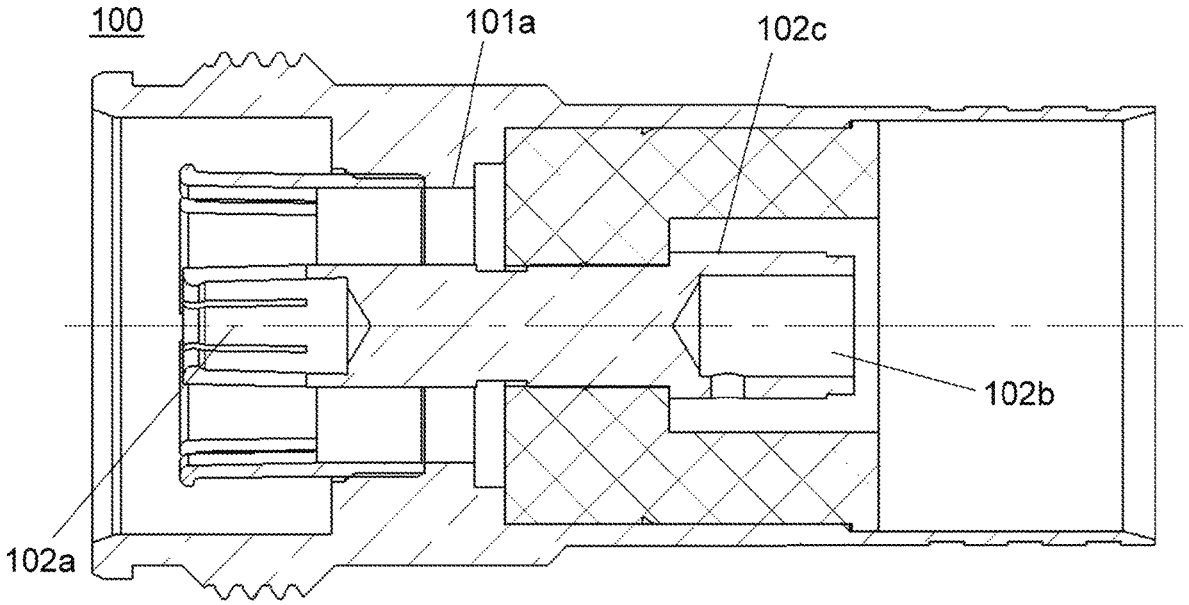
FIG. 1 is a sectional view of a female connector according to an embodiment of the present disclosure.
Figure 2:
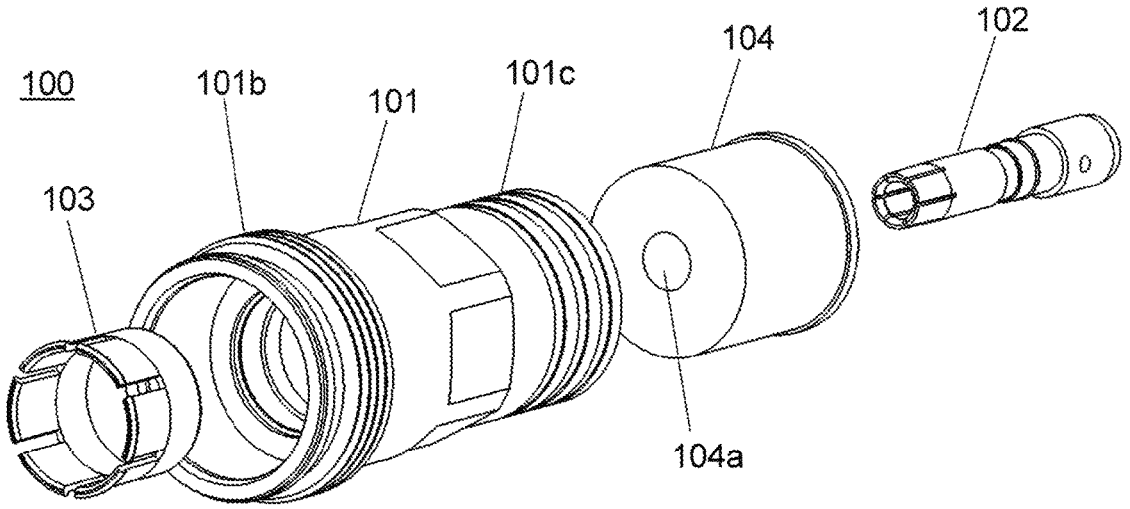
FIG. 2 is an exploded perspective view of the female connector shown in FIG. 1.

FIG. 1 and FIG. 2 respectively illustrate a cross-sectional view and an exploded perspective view of a female connector 100 according to an embodiment of the present disclosure. As shown in FIG. 1 and FIG. 2, the female connector 100 according to embodiments of the present disclosure comprises a body 101, an inner contact 102, an outer contact 103 and a dielectric spacer 104. The body 101 is provided with a through hollow cavity, and all of the inner contact 102, the outer contact 103 and the dielectric spacer 104 are arranged in the hollow cavity of the body 101.

The interior of the body 101 is provided with a step-shaped stop 101*a*, and the outer contact 103 and the dielectric spacer 104 are arranged on each side of the stop 101*a* respectively. On the outer wall of the body 101, there are threaded zones 101*b* and 101*c*. The threaded zone 101*b* is located on the proximal end of the body 101 for forming a mechanical connection of the female connector with the male connector via a coupling nut; the threaded zone 101*c* is located on the distant end of the body 101 for securing the coaxial cable or other means to the female connector via a securing nut.

The inner contact 102 is in a shape of elongated cylinder. On the proximal end and the distant end of the inner contact 102, there are provided with hollow cavities 102*a* and 102*b* respectively. A plurality of slots are provided on the wall of the hollow cavity 102*a* at the proximal end of the inner contact 102. The plurality of slots are spaced apart circumferentially and extending a specific length axially. The length of the slots may be smaller than or equal to the length of the hollow cavity 102*a*. The hollow cavity 102*a* is used to receive the inner contact (e.g., a pin or a post) of a male connector. The hollow cavity 102*b* on the distant end of the inner contact 102 is used to receive, for example, the inner conductor of a coaxial cable.

The dielectric spacer 104 functions to support and position the inner contact 102. A through-hole 104*a* is provided in the center of the dielectric spacer 104. The inner contact 102 may be supported by the through-hole 104*a* and positioned by means of the step-shaped stop 102*c* on the outer wall of the inner contact 102. In such a way, the inner contact 102 may be positioned coaxially inside the outer contact 103 and spaced apart with the outer contact 103.

Figure 3:
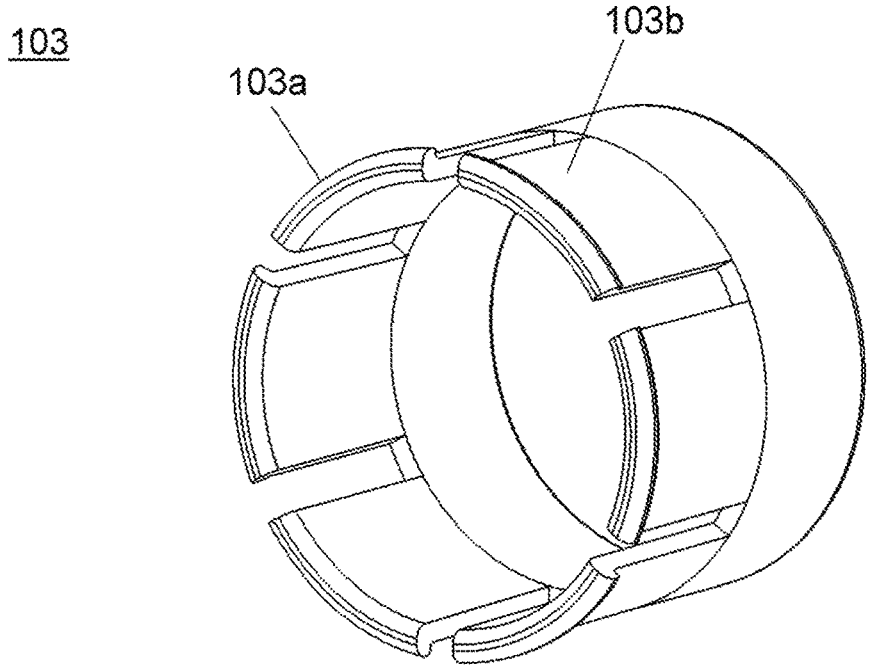
FIG. 3 is a perspective view of an outer contact of the female connector shown in FIG. 1.
Figure 4:
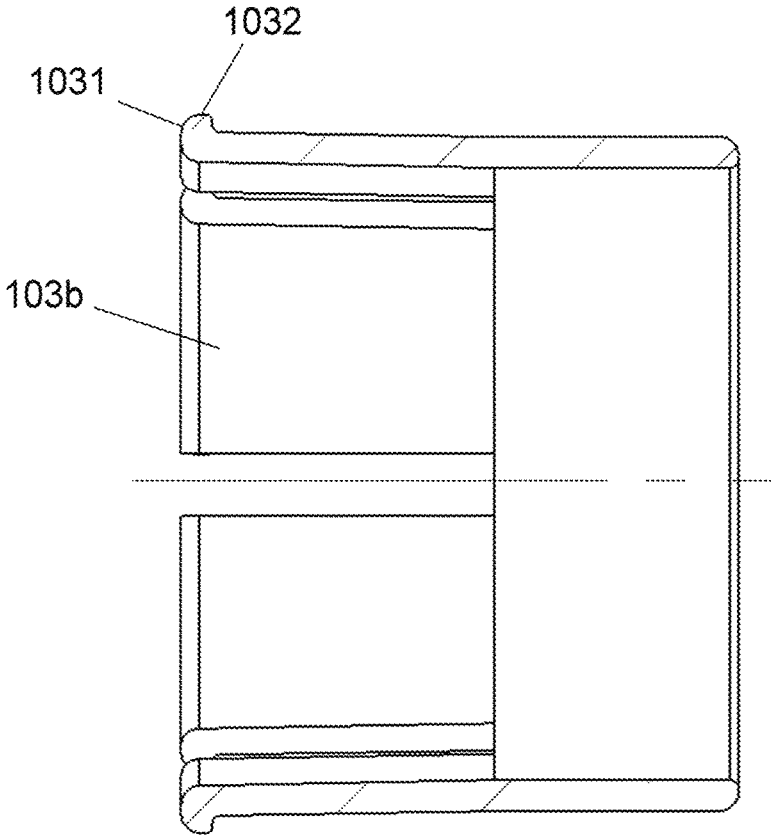
FIG. 4 is a sectional view of the outer contact of the female connector shown in FIG. 1.

FIG. 3 and FIG. 4 respectively illustrate a perspective view and a cross-sectional view of the outer contact 103 of the female connector according to an embodiment of the present disclosure. The outer contact 103 is in a shape of thin-wall cylinder. A plurality of slots are provided on the outer contact 103. The plurality of slots extend a specific length axially from the proximal end toward the distal end of the outer contact 103 and are spaced apart circumferentially, thus forming spring fingers 103*b*.

The length of the slots (which correspond to the length of the spring fingers 103*b*) are properly chosen to control the elastic restoring force of the spring fingers 103*b* when the female connector mates with the male connector. A larger elastic restoring force may guarantee a good electrical connection and mechanical connection between the outer contact 103 and the respective outer contact of male connector, and thus obtains a good interconnection quality.

On the proximal end of each spring finger 103*b*, there is a flange 103*a*. The flanges 103*a* extend outwardly to a specific radial distance along radial direction, so as to make the maximum outer diameter of the outer contact 103 slightly bigger than the inner diameter of the outer contact of the male connector, and thus make the spring finger 103*b* of the outer contact 103 generate a proper elastic deformation radially when mating with the male connector.

The elastic deformation of the spring fingers 103*b* in the radial direction may be controlled by controlling the radial distance of the flange 103*a*. Generally, the elastic deformation of the spring finger 103*b* in the radial direction may be as small as possible. The elastic deformation may be equal to or less than 0.30 mm, for example, be equal to or less than 0.25 mm, 0.20 mm, 0.15 mm, and so on. Correspondingly, the maximum outer diameter of the outer contact 103 is larger than the inner diameter of the outer contact of male connector about 0.30 mm, 0.25 mm, 0.20 mm, 0.15 mm, and so on. Reduction of the elastic deformation of the outer contact 103 in the radial direction may have following advantages: 1) reducing the elastic yield of the spring fingers 103*b*, so as to increase lifetime of the female connector as long as possible; 2) facilitating to produce linear signal characteristics when the female connector mates with the male connector, which facilitates to reduce the difference between static PIM and dynamic PIM, so as to improve the interconnection performance of the connectors; and 3) facilitating to avoid the occurrence of mating with an male connector of a similar specification mistakenly.

As shown in FIG. 4, the flange 103*a* may comprise an arc portion 1031 and a flat portion 1032. The arc portion 1031 and the flat portion 1032 are smoothly connected or have a smooth transition. For example, the arc portion 1031 and the flat portion 1032 may be connected via the smooth transition therebetween. The smooth transition may be a separate portion, or may be a part of the arc portion. The combination of the arc portion 1031 and the flat portion 1032, on one hand, enables the outer contact 103 easily mate with the outer contact of the male connector, and on the other hand, enables to form an interfacial contact between the outer contact 103 with the outer contact of the male connector. Such a structure may generate a relatively low PIM, and thus may reduce the adverse effects of the nonlinear signal characteristics to the radio frequency signal and may improve the interconnection quality of the coaxial connectors.

The present disclosure also relates to a method for producing an outer contact 103 of a coaxial connector. In said method, the outer contact 103 may be produced by stamping a tube with a uniform wall thickness. Specifically, the method comprises the following steps:

providing a tube, a wall thickness of the tube is substantially equal to a wall thickness of the outer contact and an outer diameter of the tube is smaller than a predetermined maximum outer diameter of the outer contact;

stamping a plurality of slots on the tube, said plurality of slots extending a specific length from a proximal end toward a distal end axially and spaced apart from each other circumferentially, thereby forming a plurality of spring fingers;

stamping and everting an end of each spring finger of said plurality of spring fingers to form a flange extending outwardly to a specific distance along a radial direction.

The flange 103*a* may be configured to form an interfacial contact with the corresponding portion of a mating connector. The flange 103*a* may be formed with an arc portion 1031 and a flat portion 1032. The arc portion 1031 and the flat portion 1032 of the flange 103*a* may be formed simultaneously with the flange 103*a* by stamping, which will decreases the processing steps, shortens the processing time, and decreases the processing cost. However, the arc portion 1031 and the flat portion 1032 of the flange 103*a* may also be formed by a later process procedure after the formation of the flange 103*a*. For example, the arc portion 1031 and the flat portion 1032 may be formed by machining after the formation of the flange 103*a*.

The arc portion 1031 and the flat portion 1032 may be configure to smoothly connect with each other or have a smooth transition. For example, the arc portion 1031 and the flat portion 1032 may be formed as connected via the smooth transition therebetween. The smooth transition may be formed as a separate portion, or may be formed as a part of the arc portion 1031.

The distance to which the flange 103*a* extends outwardly along the radial direction is configured to make the elastic deformation of the spring fingers in the radial direction equal to or less than 0.30 mm when the coaxial connector mates with a corresponding mating connector.

According to an embodiment of the present disclosure, the wall thickness of the tube is approximately 0.50 mm. The tube may be a copper tube, and more preferably, may be a phosphorus copper tube. Of course, the present disclosure is not limited to this. Tubes with other wall thicknesses or of other materials may be chosen as required.

There are following advantages for producing the outer contact of the female connector using the aforementioned method: 1) compared with the traditional method of machining a bar stock, stamping the tube produces little waste, which significantly saves the material cost; 2) stamping is convenient, takes less time, and is more efficient, which reduces the time and personnel costs; and 3) compared with the prior method of stamping a sheet, stamping the tube will not produce splice seams, and thus avoid the problem that the splice seams are unreliable or likely to split open, etc., thereby provides a better interconnection quality.

Although the female connector according to the present disclosure is mainly used in the radio frequency communication systems, the female connector may also be used in other suitable field. In addition, the female connector according to the present disclosure may be mounted on the coaxial connector, or may be mounted on the interfaces of outer mobile devices, or even may mate with corresponding male connector without attaching any means.

Although the present disclosure has been described with reference to particular exemplary embodiments, yet the present disclosure is not limited by these exemplary embodiments. It should be appreciated that a person skilled in the art is able to make variations and modifications to these exemplary embodiments without departing from the scope and spirit defined by the claims of the present disclosure or equivalent contents thereof.

The invention claimed is:

1. A coaxial connector comprising a body, an inner contact, an outer contact, and a dielectric spacer, wherein the body is provided with a through hollow cavity, the inner contact and the outer contact are coaxially arranged in the hollow cavity of the body and are spaced apart radially by the dielectric spacer;

wherein the outer contact is in a shape of thin-wall cylinder and comprises a plurality of spring fingers, said plurality of spring fingers are spaced apart circumferentially by a plurality of slots, an end of each spring finger is provided with a flange, the flanges extend outwardly in a radial direction; and wherein the outer contact is formed by stamping a tube; and wherein when the coaxial connector mates with a corresponding mating connector, elastic deformations of the spring fingers in radial direction are equal to or less than 0.30 mm.

2. The coaxial connector according to claim 1, wherein the flange of each spring finger comprises an arc portion and a flat portion.

3. The coaxial connector according to claim 2, wherein the arc portion and the flat portion are connected smoothly or has a smooth transition.

4. The coaxial connector according to claim 1, wherein when the coaxial connector mates with a corresponding mating connector, the flanges form an interfacial contact with respective portions of a mating connector.

5. A method for producing an outer contact of a coaxial connector, wherein the outer contact is in a shape of thin-wall cylinder, the method comprising:

providing a tube, a wall thickness of the tube is substantially equal to a wall thickness of the outer contact and an outer diameter of the tube is smaller than a predetermined maximum outer diameter of the outer contact;

stamping a plurality of slots on the tube, said plurality of slots extending a specific length from a proximal end toward a distal end axially and spaced apart from each other circumferentially, thereby forming a plurality of spring fingers;

stamping and everting an end of each spring finger of said plurality of spring fingers to form a flange extending outwardly to a specific distance along a radial direction.

6. The method according to claim 5, wherein the flange of each spring finger is formed with an arc portion and a flat portion.

7. The method according to claim 6, wherein the arc portion and the flat portion of the flange are configure to smoothly connect with each other or have a smooth transition.

8. The method according to claim 6, wherein the arc portion and the flat portion of the flange are formed by stamping.

9. The method according to claim 6, wherein the arc portion and the flat portion of the flange are formed by machining.

10. The method according to claim 5, wherein the flanges are configured to form an interfacial contact with respective portions of a mating connector when the coaxial connector mates with a corresponding mating connector.

11. The method according to claim 5, wherein the spring fingers are configured to have elastic deformations being equal to or less than 0.30 mm in the radial direction when the coaxial connector mates with a corresponding mating connector.

* * * * *